United States Patent [19]

Takahashi et al.

[11] Patent Number: 4,568,904

[45] Date of Patent: Feb. 4, 1986

[54] TEMPERATURE SENSING SWITCH

[75] Inventors: Tadahiro Takahashi; Hidehumi Takahashi, both of Konan, Japan

[73] Assignee: Diesel Kiki Company, Ltd., Tokyo, Japan

[21] Appl. No.: 648,188

[22] Filed: Sep. 7, 1984

[30] Foreign Application Priority Data

Sep. 22, 1983 [JP] Japan ..... 58-146786[U]

[51] Int. Cl.[4] ..... H01H 61/02; H01H 71/18

[52] U.S. Cl. ..... 337/140; 337/354

[58] Field of Search ..... 337/140, 354, 12, 299, 337/308; 236/227, 228; 60/527

[56] References Cited

U.S. PATENT DOCUMENTS 4,350,967 9/1982 Doherty, Jr. ..... 337/354

*Primary Examiner*—Harold Broome

*Attorney, Agent, or Firm*—David G. Alexander

[57] ABSTRACT

A single temperature sensing switch is responsive to two or more different ambient temperatures is disclosed. A contact mechanism made up of stationary and movable contacts is opened and closed by serially interconnected first and second temperature-sensitive members, which are made of shape memorizing alloys having different transformation points. The switch may be associated with a compressor of an automotive air conditioning system in order to prevent it from being heated beyond a siezing level or cooled beyond a liquid compressing level.

8 Claims, 12 Drawing Figures

TEMPERATURE SENSING SWITCH

BACKGROUND OF THE INVENTION

The present invention relates to a temperature sensing switch which may be associated with, for example, a compressor included in an air conditioning system of a motor vehicle.

A compressor of an automotive air conditioning system, for example, is apt to seize when heated beyond a certain temperature level during operation due to shortage of refrigerant or like cause. To eliminate this, there have been proposed systems which upon elevation of compressor temperature above such a level stop the operation of the compressor to thereby protect it from seizure, as disclosed in Japenese Utility Model Laid-Open Publication No. 55-130087/1980 (referred to as former prior art hereinafter), for example. Meanwhile, when the compressor is cooled below a certain temperature sucking liquid refrigerant therein, the liquid becomes compressed to damage valves and other structural elements of the compressor. Deactivating a compressor for protection against cooling beyond the critical temperature is described in, for example, Japenese Utility Model Laid-Open Publication No. 56-127390/1981 (referred to as latter prior art hereinafter).

The former prior art uses a bimetallic strip for sensing compressor temperature and the latter prior art, a PTC thermistor. It may readily be contemplated in view of the former prior art to actuate a movable contact of a contact mechanism by use of a temperature-sensitive member which is made of a shape memorizing alloy. However, the implementation taught by the former prior art is responsive only to excessive rise of compressor temperature, and that taught by the latter prior art only to excessive drop of the same. That is, it is impossible to sense both the excessive rise and excessive drop of temperature without resorting to two independent temperature sensing sections and, hence, without making the switch arrangement bulky. A compact design of such a switch would minimize a space required for installation and promote the ease of electrical wiring.

SUMMARY OF THE INVENTION

It is therefore an object of the present invention to provide a temperature sensing switch which is responsive to a plurality of different levels of ambient temperature, thereby rendering the temperature sensing arrangement compact.

It is another object of the present invention to provide a temperature sensing switch which is space-effective and easy to wire.

It is another object of the present invention to provide a generally improved temperature sensing switch.

A temperature sensing switch of the present invention comprises a housing, at least one stationary contact and a movable contact associated with the stationary contact, and a temperature-sensitive single actuator. The stationary and movable contacts and the actuator are disposed in the housing. The actuator moves the movable contact relative to the stationary contact in response to a plurality of different predetermined levels of ambient temperature.

In accordance with the present invention, a single temperature sensing switch is responsive to two or more different ambient temperatures. A contact mechanism made up of stationary and movable contacts is opened and closed by serially interconnected first and second temperature-sensitive members, which are made of shape memorizing alloys having different transformation points. The switch may be associated with a compressor of an automotive air conditioning system in order to prevent it from being heated beyond a siezing level or cooled beyond a liquid compressing level.

The above and other objects, features and advantages of the present invention will become apparent from the following detailed description taken with the accompanying drawings.

DESCRIPTION OF THE PREFERRED EMBODIMENTS

While the temperature sensing switch of the present invention is susceptible of numerous physical embodiments, depending upon the environment and requirements of use, substantial numbers of the herein shown and described embodiments have been made, tested, and used, and all have performed in an eminently satisfactory manner.

Figure 1:
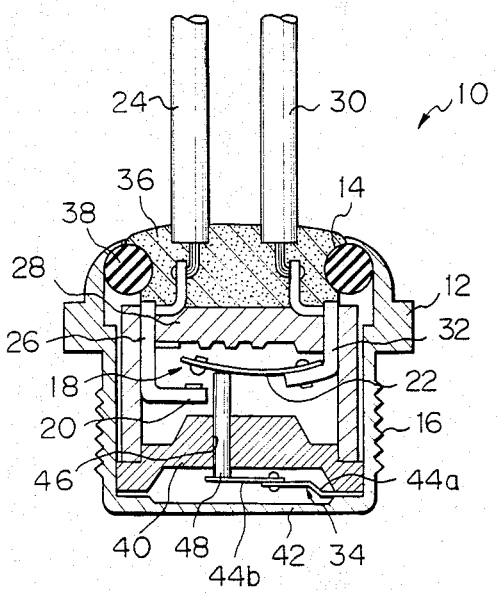
FIGS. 1–3 are sections showing a temperature sensing switch of the present invention in different positions associated with different ambient temperatures.
Figure 2:
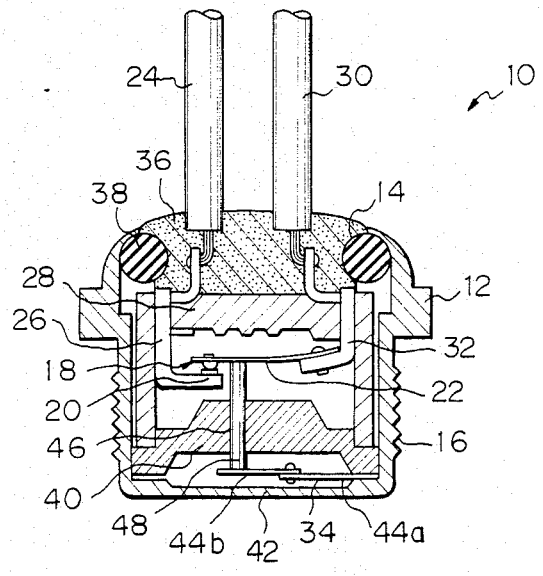
Figure 3:
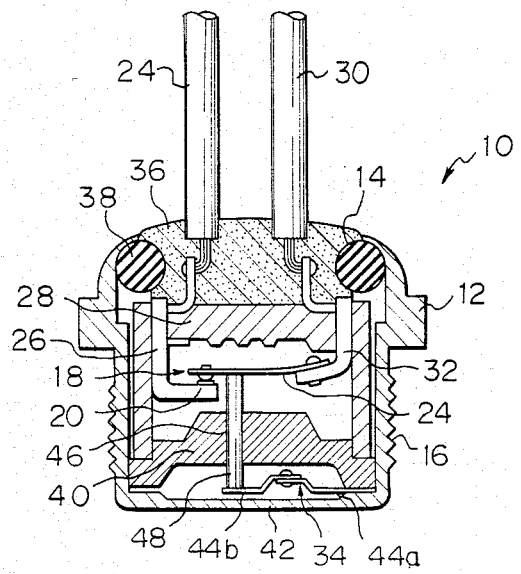

Referring to FIGS. 1–3, a temperature sensing switch embodying the present invention is shown and generally designated by the reference numeral 10. The switch 10 comprises a generally cup-shaped housing 12 which is made of an aluminum alloy or like metal and formed with an opening 14 at its top. The edge of the open house top is bent radially inwardly as illustrated. The housing 12 has a screw-threaded portion 16 on its outer periphery in order to be engaged with a structural member of a desired device, e.g. a compressor of an automotive air conditioning system.

A contact mechanism, generally 18, is disposed in the housing 12 and comprises a stationary contact 20 and a movable contact 22 coactive with the stationary contact 20 as will be described. The stationary contact 20 is electrically connected to a lead 24 by a conductive member 26, which is supported by a base 28. Likewise, the movable contact 22 is electrically connected to a lead 30 by a conductive member 32, which is also supported by the base 28. The contact mechanism 18 is opened and closed by a temperature-sensitive single actuator 34 which will be described later, the resulting electrical signal being sent out over the leads 24 and 30. An elastic filler 36, made of epoxy resin or the like, plugs the opening 14 of the housing 12, while an O-ring 38 is positioned between the rim of the open top of the housing 12 and the fillter 36 and engaged with the inwardly bent rim of the same. In this construction, the base 28 is constantly urged toward the bottom of the housing 12.

Further, a guide block 40 is firmly retained between the lower end of the base 28 and a bottom wall 42 of the housing 12. The guide block 40 in turn retains the previously mentioned temperature-sensitive actuator 34 in cooperation with the housing bottom wall 42. In the illustrative embodiment, the actuator 34 comprises elongate first and second flat, metal members 44*a* and 44*b* which are securely connected together and made of shape memorizing metals having different transformation points. The guide block 40 is formed with a through bore 46, while a pin 48 is slidably received in the bore 46. The pin 48 abuts at one end against the movable contact 22 of the contact mechanism 18 and at the other end against the free end of the cantilevered actuator 34, specifically metal member or strip 44*b*.

In this particular embodiment, the metal strip 44*a* retained at one end between the guide piece 40 and the housing bottom 42 has a transformation point at a high temperature side, and the metal strip 44*b* extending from the metal strip 44*a* has it at a low temperature side. The switch 10 assumes the position shown in FIG. 1 in a medium temperature range, the position shown in FIG. 2 in a high temperature range, and the position shown in FIG. 3 in a low temperature range, as will be explained in detail.

While the temperature around the switch 10 lies in a medium temperature range defined by predetermined first and second reference levels, the metal strip 44*a* remains bent upwardly halfway between its opposite ends, as shown in FIG. 1. In this condition, the other metal strip 44*b* which is straight raises the pin 48 and, thereby, the movable contact 22 out of engagement with the stationary contact 20, the contact mechanism 18 thus being kept open.

Upon elevation of the ambient temperature beyond the first reference level, the metal strip 44*a* is straightened lowering its associated metal strip 44*b*, as shown in FIG. 2. Then, the metal strip 44*b* allows the pin 48 and, thereby, the movable contact 22 to move downward; the movable contact 22 is brought into engagement with the stationary contact 20 to close the contact mechanism 18.

As the ambient temperature is lowered beyond the second reference level, the actuator 34 is deformed from the position FIG. 1 to that of FIG. 3. Specifically, while the metal strip 44*a* remains bent upwardly, the other metal strip 44*b* becomes bent downwardly. As a result, the pin 48 is lowered as in the case of the elevation of the temperature, thereby allowing the movable contact 22 to engage with the stationary contact 20 to close the contact mechanism 18.

Figure 4:
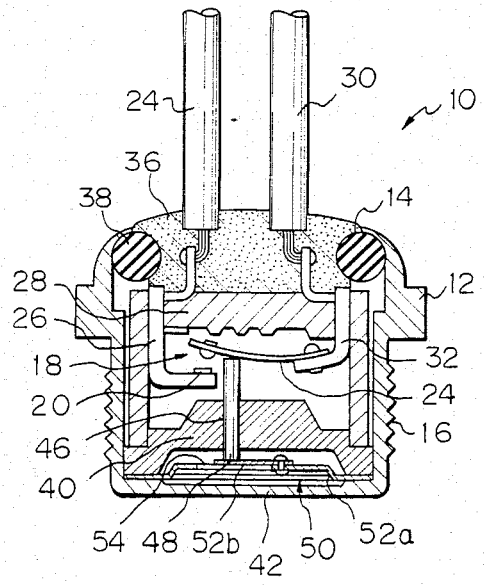
FIG. 4 is a section of another embodiment of the present invention.
Figure 5:
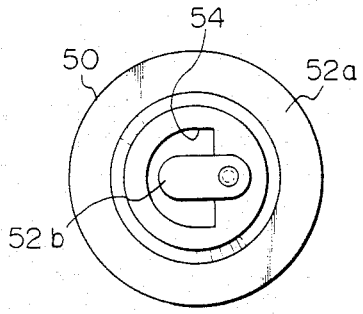
FIG. 5 is a plan view of temperature-sensitive members included in the arrangement of FIG. 4.

Referring to FIGS. 4 and 5, another embodiment of the present invention is shown. In these drawings, the same or similar structural elements as shown in FIGS. 1–3 are designated by like reference numerals and details thereof will not be described for simplicity. As shown, a temperature-sensitive actuator 50 in the second embodiment is made up of a disk-like first metal member 52*a* and a tongue-like second metal number 52*b* securely connected to the first metal member 52 at one end thereof. It will be seen that the disk 52*a* and the tongue 52*b*, each being made of a shape memorizing alloy, are respectively the matches of the metal strips 44*a* and 44*b* of the first embodiment. The disk 52*a* is rigidly retained between the guide piece 40 and the housing bottom 42 along the rim thereof. The disk 52*a* is formed with an opening 54 which allows the tongue 52*b* to be deformable in the manner discussed in relation with the first embodiment. The switch shown in FIG. 4 operates in the same manner as the switch of FIGS. 1–3 in response to the varying ambient temperature.

It will be seen that the embodiment shown in FIGS. 4 and 5 enhances sure restraint and easy positioning of the temperature-sensitive actuator, because the rim of the metal disk 52*a* is held between the guide piece 40 and the housing bottom 42 therethroughout.

While the contact mechanism 18 has been shown and described in any of the foregoing embodiments as having a single stationary contact, 20, another stationary contact may be mounted, for example, on the base 28 in such a manner as to face the stationary contact 20. Such would allow the contact mechanism 18 to make and break in two steps. Also, three or more pieces made of shape memorizing alloys may be connected together such that the contact mechanism 18 makes and breaks in three or more steps.

Hereinafter will be described an exemplary application of the temperature sensing switch of the present invention to compressor control in an automotive air conditioning system.

Figure 6:
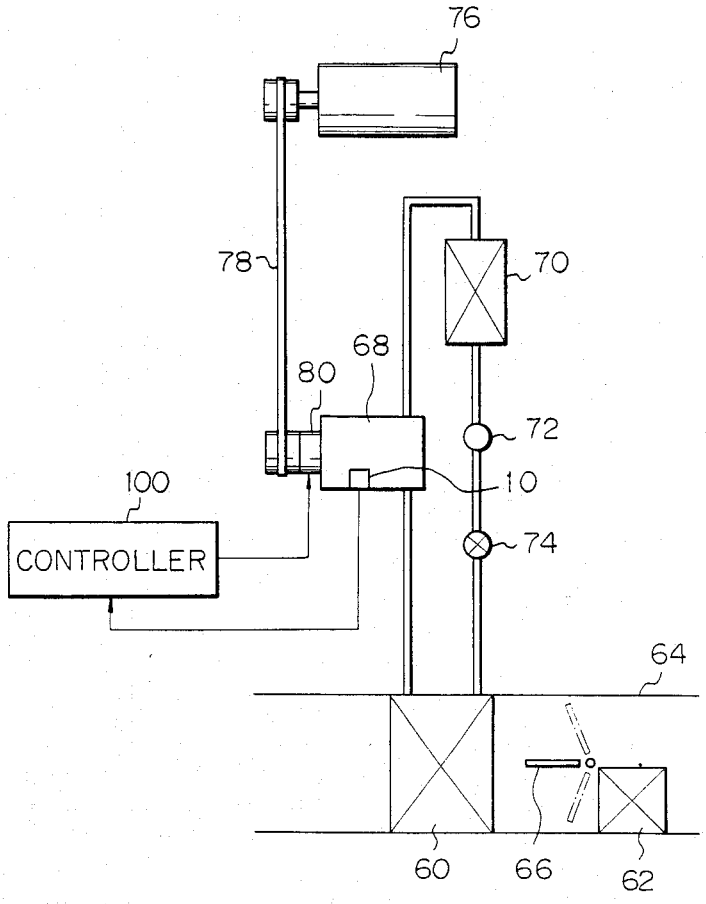
FIG. 6 is a schematic diagram representative of a compressor control mechanism of an automotive air conditioning system to which the present invention is applicable.

Referring to FIG. 6, an automotive air conditioning system includes an evapoater 60 and a heater core 62 located in a conduitwork 64 of the system. Air flown past the evaporator 60 is divided by an air mix door 66 into two parts: one to be directed toward the heater core 62 and the other to bypass the heater core 62. In a predetermined position downstream the air mix door 66, the two parts of the air are mixed together and blown out into a passenger compartment of the motor vehicle. The evaporator 60 is communicated by a piping with a compressor 68, a condensor 70, a liquid reservoir 72, and an expansion valve 74, thereby setting up a refrigeration cycle as well known in the art. The compressor 68 is driven from an engine 76 of the motor vehicle. Specifically, the compressor 68 is in driven connection with the engine 76 via a belt drive 78 and a solenoid-operated clutch 80.

The temperature sensing switch 10 of the present invention is in mounted in the compressor 68. An on-off signal output from the switch 10 and respresentative of a sensed compressor temperature is applied to a control circuit 100 which is adapted to on-off control the solenoid-operated clutch 80.

Figure 7:
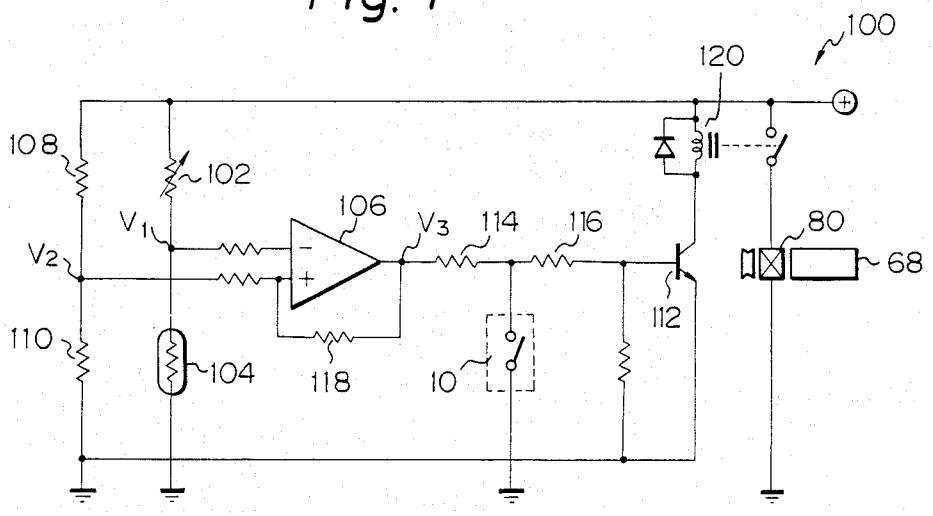
FIG. 7 is a diagram showing a first example of a control circuit included in the compressor control mechanism of FIG. 6.

Referring to FIG. 7, a first example of the control circuit 100 is shown and includes a variable temperature setter 102 adapted to preset a temperature for turning on and off the compressor 102. An evaporator sensor 104 is associated with the evaporator 60 (see FIG. 6) so as to sense a fin temperature of the evaporator 60 or a temperature of air just flown past the evaporator 60. A voltage V, developing at the junction between the temperature setter 102 and the evaporator sensor 104 is applied to an inverting input of an operational amplifier (op amp) 106. The voltage $V_1$ is compared with a predetermined reference voltage $V_2$ developed by resistors 108 and 110, which is applied to a noninverting input of the op amp 16. The output voltage $V_3$ of the op amp 106 is routed to a transistor 112 via resistors 114 and 116, while being fed back to the non-inverting input via a resistor 118. The junction between the resistors 114 and 116 is connected to ground via the temperature sensing switch 10.

Figure 8:
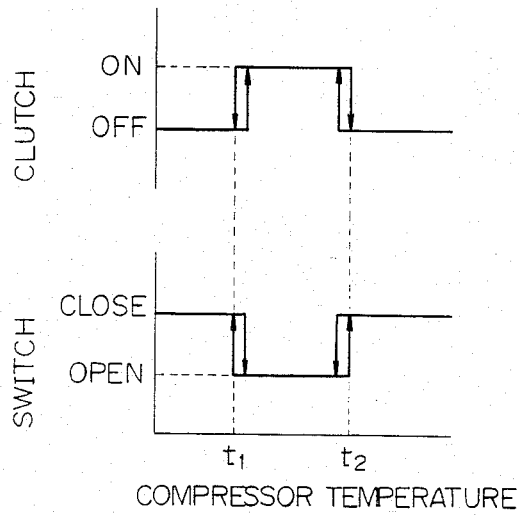
FIG. 8 is a diagram demonstrating the operation of the control circuit shown in FIG. 7.

Referring also to FIG. 8, the operation of the control circuit shown in FIG. 7 will be described. While the switch 10 is open, the output voltage $V_3$ of the op amp 106 is low level, "L", when $V_1 > V_2$ and high level, "H", when $V_1 < V_2$. The voltage $V_3$ is applied via the resistors 114 an 116 and transistor 112 to a relay 120, thereby on-off controlling current supply to the clutch 80. Meanwhile, when the switch 10 is closed, the output voltage $V_3$ of the op amp 35 is connected to ground via the switch 10 so that the transistor 112 and, therefore, the relay 120 is turned off to deactivate the compressor 68 via the clutch 80. As shown in FIG. 8, the switch 10 closes when the compressor 68 is cooled to a first reference temperature $t_1$ (e.g. 20° C.) or heated to a second reference temperature $t_2$ (e.g. 150° C.), or that the clutch 80 controls the compressor 68 as illustrated. Such a control characteristic is successfull in preventing siezure and liquid compression of the compressor 68 at the same time.

Figure 9:
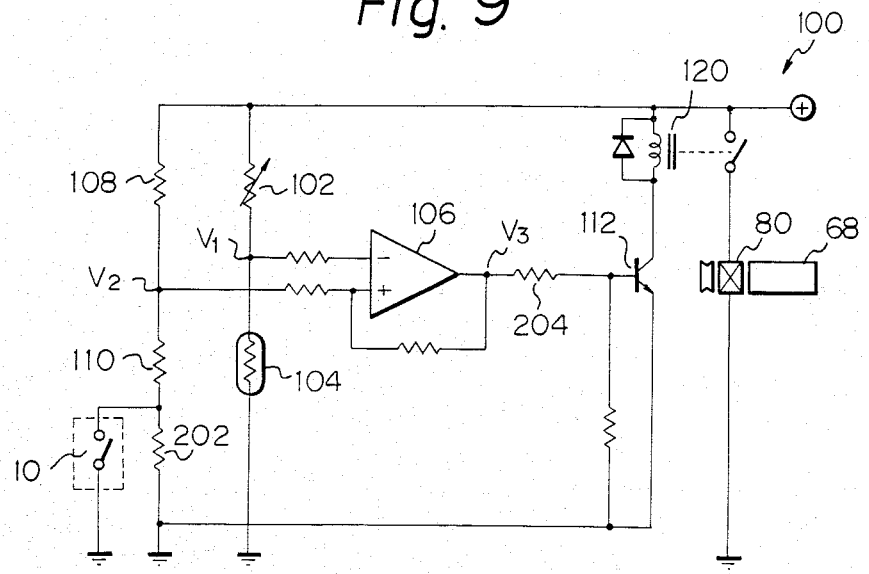
FIG. 9 is a diagram of a second example of the control circuit.
Figure 10:
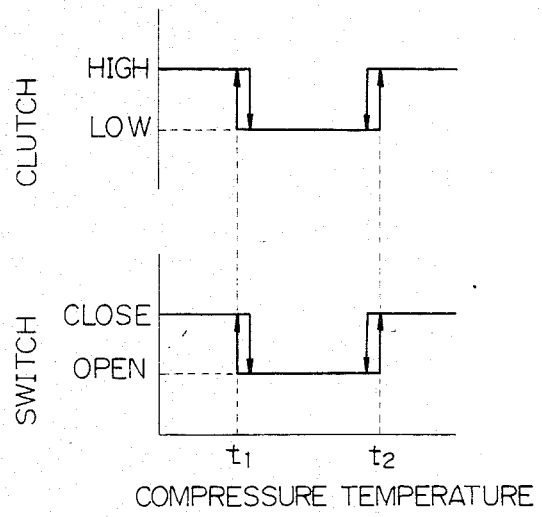
FIG. 10 is a diagram demonstrating the operation of the control circuit shown in FIG. 9.

A second example of the control circuit 100 is shown in FIG. 9 and its operation in FIG. 10. The control circuit 100 in FIG. 9 differs from the control circuit 100 of FIG. 7 in that it connects to the switch 10 at a different part thereof, and in that it includes another resistor 202. With this construction, the control circuit 100 allows the reference voltage $V_2$ applied to the op amp 106 to have either one of predetermined higher and lower values depending upon the open/closed condition of the switch 10. That is, as shown in FIG. 10, when the switch 10 is closed, the control circuit 100 raises a reference temperature with respect to which the compressor 68 is to be turned on and off. In accordance with this particular example, therefore, the working ratio of the compressor 68 is lowered when the compressor 68 is apt to sieze or cause liquid compression, thereby eliminating such accidents. In FIG. 9, the reference numeral 204 designates a register.

Figure 11:
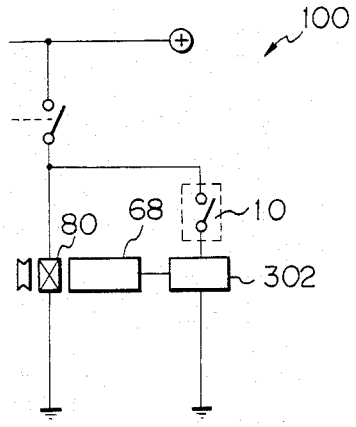
FIG. 11 is a diagram of a third example of the control circuit.
Figure 12:
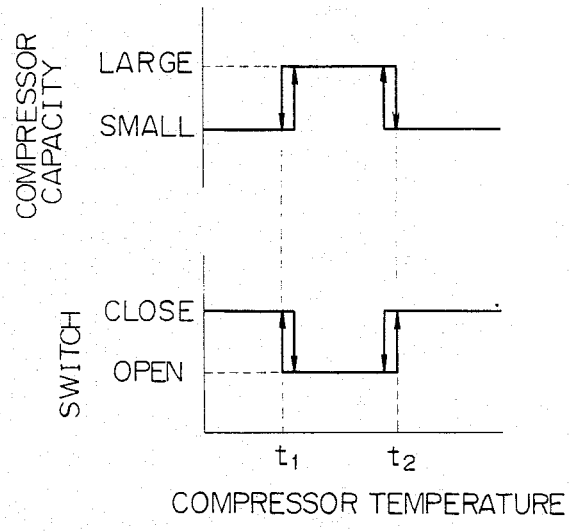
FIG. 12 is a diagram demonstrating the operation of the control circuit shown in FIG. 11.

Referring to FIG. 11, a third example of the control circuit 100 is shown. The control circuit 100 is constructed to increase and decrease the capacity of the compressor 68 by means of a device 302, instead of coupling and uncoupling the solenoid-operated clutch 80. In the case where the compressor 68 is of the swash plate type, the device 302 controls the angular position of a swash plate; in the case where the compressor 68 is of the vane type, it controls the number of effective vanes. Besides, the device 302 may comprise any known implementation so long as it is capable of substantially changing the capacity of the compressor 68, e.g., changing the quantity of discharged gaseous refrigerant returned to a suction side or changing the pulley ratio of the belt drive 78. In accordance with the third example of the control circuit 100, the capacity of the compressor 68 is controlled as shown in FIG. 12 in accordance with the temperature, so as to to prevent siesure and liquid compression.

While the preferred embodiments of the present invention have been shown and described in relation with a compressor of an automotive air conditioning system, it is similarly applicable to any other device the temperature of which is apt to rise and drop to undesired degrees in the course of operation.

In summary, it will be seen that the present invention provides a temperature sensing switch which is capable of generating an on-off signal in a plurality of stages without the help of any other switch. Such realizes a compact temperature sensing switch which requires a minimum of space for installation and facilitates wiring.

Various modifications will become possible for those skilled in the art after receiving the teachings of the present disclosure without departing from the scope thereof.

What is claimed is:

1. A temperature sensing switch comprising:

a housing;

at least one stationary contact and a movable contact associated with said stationary contact, said stationary and movable contacts being disposed in said housing; and temperature-sensitive single actuator means disposed in the housing for moving said movable contact into and out of engagement with said stationary contact in response to each of plurality of different predetermined levels of ambient temperature;

the actuator means comprising first and second members having different transformation points and interconnected serially with each other;

the first member comprising a strip anchored at one end to the housing while the second member comprises a strip rigidly connected at one end to the other end of the first member;

the actuator means further comprising a pin which is abutted at one end against the other end of the second member and at the other end against the movable contact.

2. A temperature sensing switch as claimed in claim 1, in which the actuator means moves the movable contact into engagement with the stationary contact when the ambient temperature is above a first predetermined level and below a second predetermined level lower than said first predetermined level, while keeping the movable contact disengaged from the stationary contact when the temperature lies between said first and second levels.

3. A temperature sensing switch as claimed in claim 1, in which the first and second members are made of shape memorizing alloys.

4. A temperature sensing switch comprising:

a housing;

at least one stationary contact and a movable contact associated with said stationary contact, said stationary and movable contacts being disposed in said housing; and temperature-sensitive single actuator means disposed in the housing for moving said movable contact into and out of engagement with said stationary contact in response to each of plurality of different predetermined levels of ambient temperature;

the actuator means comprising first and second members having different transformation points and interconnected serially with each other;

the first member comprising a disk-like member anchored to the housing along a rim thereof while the second member comprises a tongue-like member rigidly fit at one end on said disk-like member, said disk-like member being formed with an aperture to accomodate the tongue-like member when the tongue-like member is deformed;

the actuator means further comprising a pin which is abutted at one end against the other end of the second member and at the other end against the movable contact.

5. A temperature sensing switch as claimed in claim 1, in which the switch is adapted to be associated with a compressor of an air conditioning system of a motor vehicle.

6. A temperature sensing switch as claimed in claim 4, in which the actuator means moves the movable contact into engagement with the stationary contact with the ambient temperature is above a first predetermined level and below a second predetermined level lower than said first predetermined level, while keeping the movable contact disengaged from the stationary contact when the temperature lies between said first and second levels.

7. A temperature sensing switch as claimed in claim 4, in which the first and second members are made of shape memorizng alloys.

8. A temperature sensing switch as claimed in claim 4, in which the switch is adapted to be associated with a compressor of an air conditioning system of a motor vehicle.

* * * * *